US005245365A

United States Patent [19]

Woodard et al.

[11] Patent Number: 5,245,365

[45] Date of Patent: Sep. 14, 1993

[54] INK-JET PRINTER WITH USER REPLACEABLE PRINTING SYSTEM CARTRIDGE

[75] Inventors: Thomas R. Woodard, Tomball; Mickey H. Everett, Spring, both of Tex.

[73] Assignee: Compaq Computer Corporation, Houston, Tex.

[21] Appl. No.: 847,430

[22] Filed: Mar. 6, 1992

Related U.S. Application Data

[63] Continuation of Ser. No. 486,257, Feb. 28, 1990.

[51] Int. Cl.[5] ..... B41J 2/01

[52] U.S. Cl. ..... 346/140 R

[58] Field of Search ..... 346/1.1, 140 R, 145, 346/76 PH; 400/126, 175, 354, 352, 354.3, 692; 355/210, 211

[56] References Cited

U.S. PATENT DOCUMENTS

| | | | |
|---|---|---|---|
| 4,345,262 | 8/1982 | Shirato et al. | 346/140 R |
| 4,450,454 | 5/1984 | Koto | 346/140 R |
| 4,577,200 | 3/1986 | Rix et al. | 346/140 R |
| 4,630,075 | 12/1986 | Hori | 346/140 R |
| 4,811,035 | 3/1989 | Huliba et al. | 346/75 |
| 4,841,333 | 6/1989 | Damji | 355/211 |
| 4,939,541 | 7/1990 | Sugiura | 346/76 PH |
| 4,943,815 | 7/1990 | Aldrich et al. | 346/108 |
| 4,983,991 | 1/1991 | Palonen | 346/76 PH |
| 5,063,451 | 11/1991 | Yanagisawa et al. | 400/126 |
| 5,129,751 | 7/1992 | Piller et al. | 400/692 |

FOREIGN PATENT DOCUMENTS

| | | | |
|---|---|---|---|
| 0139774 | 6/1988 | Japan | 400/691 |

*Primary Examiner*—Benjamin R. Fuller
*Assistant Examiner*—N. Le
*Attorney, Agent, or Firm*—James R. Burdett; Irene Kosturakis

[57] ABSTRACT

An ink-jet type printer having a self-contained, unitary print-head and ink-supply cartridge which can be readily inserted or removed from the printer without requiring disconnection of or user-exposure to any part of the ink reservoir or ink delivery system. The large-capacity ink reservoir in the cartridge is separate from the ink delivery system and connected thereto by flexible hoses which allow the print-head to be moved independently from the ink supply. A drive gear for the print-head motion system, enclosed in the print-head and ink supply cartridge is partially exposed such that it engages a motor disposed within the printer housing when the cartridge is inserted into the printer housing. An elongated shutter mechanism in the cartridge opens during printing to expose the print-head to the printing surface. When the ink reservoir is exhausted, the cartridge is removed from the printer housing in a single motion.

12 Claims, 2 Drawing Sheets

INK-JET PRINTER WITH USER REPLACEABLE PRINTING SYSTEM CARTRIDGE

This is a continuation of copending application Ser. No. 07/486,257 filed on Feb. 28, 1990 now abandoned.

BACKGROUND OF THE INVENTION

The present invention relates to printers for digital data processing systems, and more particularly relates to ink-jet type printers.

A great diversity of different printing techniques for use with printers in digital computer systems have been shown. Very often, printing for digital computers is accomplished by creating a dot-matrix image of picture-element (pixel) data stored in the form of binary data in a computer. Examples of different dot-matrix printers include conventional multi-pin electro-mechanical impact printers, thermal process printers, electro-photographic printers, and more recently, laser printers and ink-jet printers. The quality of a printed image produced by such devices is frequently measured in terms of the "resolution" of the image, which in turn depends upon the minimum size and overall number of pixels per unit of area which can be produced with a particular printing process.

In addition to resolution, other useful considerations in the assessment of a printing system include the speed with which a printer can produce images, the noise made by the printer during printing, the cost of the printer, the size of the printer, the serviceability of the printer, the ease of use of the printer, the type of imaging agent used by the printer, the projected life-expectancy of the printer, and the special requirements on printing and printing materials imposed by the printer. Often, the design of printing systems represent a trade-off between certain of the above considerations. For example, while standard multi-pin impact-type dot matrix printers tend to be very fast, they also have limited resolution, on the order of one-hundred dots per inch or so, and can be very noisy during operation. Laser printers, on the other hand, are typically very fast and quiet, and have typical resolutions of three hundred dots per inch or greater; laser printers are also usually very expensive, however, their printing and paper handling mechanisms are quite complex, and they are sometimes quite large. Thermal printers are inexpensive, quiet, and fast, but permit printing only on specially prepared thermal material.

Ink-jet printers produce a pixel dot-matrix image by depositing very small droplets of liquid ink onto a printing surface. Ink-jet type printers are known to be fast and quiet, and may be somewhat less expensive than laser printers; the resolution of ink-jet printers is also typically very good, but can suffer according to the types of ink and paper used for printing. For example, some compositions of liquid ink are susceptible to "bleeding" in highly porous papers, and some glossy papers are not capable of retaining a liquid-ink image without smearing.

A number of different types of ink-jet printers have been shown in the prior art. In the so-called charged ink-droplet deflection type ink-jet printers, a series of electrically charged ink droplets are expelled from a nozzle and directed toward an absorbent printing surface, such as paper, through an electric field whose strength is modulated by the image to be reproduced; the individual charged ink-droplets are thus deflected selectively in accordance with the image as they pass through the modulated electric field. Ink which is deflected away from the paper during this process is typically collected in a trough or gutter, and possibly recirculated through the ink reservoir.

In another type of ink-jet printing, called thermal ink-jet printing, resistive heating is used to selectively vaporize liquid ink as it is expelled through an orifice. Ink not vaporized on expulsion is projected from the orifice to be received on the image surface. In still another type of ink-jet printing system, the so-called electro-pneumatic ink-jet printing system, controlled air-pressure gradients are employed to direct the flow of the liquid ink droplets toward the paper substrate. Other types of ink-jet printers are known which employ combinations or variations of the pneumatic and electrostatic techniques.

Often, an ink-jet print-head incorporates several independently controlled ink-ejecting nozzles, arranged such that several rows of pixels are printed with each pass of the print-head across the image surface. This allows more image area to be printed with each pass of the print-head over the printing surface, thus reducing the number of back-and-forth print-head passes per page and decreasing the printing time for each page.

Clearly, the aforementioned and other ink-jet type printing techniques involve delicate and complex electrical and mechanical operations which must occur in a precise, consistent and high-speed manner. Each involves the controlled propulsion of liquid ink from a reservoir to a substrate; each requires that the print-head's nozzles be moved back-and-forth with respect to the printing surface, possibly at very high rates. The motion of the print-head must be further coordinated with the motion of the printing surface being drawn past the imaging area of the print-head. Accordingly, ink-jet printers typically include complex plumbing and hydraulic systems and other very delicate or precisely adjusted mechanical components which must be maintained in an aligned configuration within the printer and which must be able to withstand the rigors of repeated movement and vibration encountered during printing.

During printing, the more delicate and intricate connections and precisely-aligned components within an ink-jet printer are not exposed to the user, and do not normally require adjustment or actuation by the user. For example, the plumbing system for conducting the liquid ink from a reservoir to an ink-jet or nozzle in an ink-jet printer is typically not accessed by the user during printing.

As with most printing systems, however, the supply of imaging agent (ink) in ink-jet printers must be periodically replenished; in particular, the ink reservoir in an ink-jet printer must occasionally either be refilled or replaced with a full reservoir; this usually involves the disconnection of various ink-conducting tubes within the printer, or the opening of the ink-containing reservoir itself. It is in such non-printing periods of operation that the deficiencies in the design of prior art ink-jet printers are most apparent.

When adding or replacing ink in an ink reservoir, there is usually a risk that some of the very high-viscosity fluid will be spilled. Furthermore, whenever the ink plumbing system is opened at any point, such as for removal of an empty reservoir, disconnection of hoses or other fittings, or removal of the print-head, that the user is exposed to small but significant amounts of uncontained ink, which may stain hands, clothing, or office furniture.

Attempts have been made in the prior art to provide ink-jet printers with "closed" ink systems in which the user is completely insulated from exposure to liquid ink. For example, some printers may employ a totally sealed unit containing the ink supply and ink-jet nozzles. The need for plumbing between the ink supply and the ink nozzles is eliminated by a direct, non-flexible connection therebetween. Replacement of the ink supply is accomplished by replacing the entire sealed unit, a "clean" operation in which the user is not exposed to liquid ink.

A significant disadvantage of the self-contained ink supply/print-head approach to preventing user-exposure is that the ink supply is coupled directly to the print head with a rigid connection, thus requiring the ink supply and plumbing system to be in motion with the print-head during printing. The weight of the ink supply increases the strain placed on the print-head motion mechanism, which must be able to move the print-head very rapidly back-and-forth across the printing area. The size of the ink reservoir must also be limited, so that the overall size of a printer utilizing the self-contained unit can be minimized. Accordingly, the amount of ink contained in the ink supply in such units is usually kept rather small; a typical self-contained ink supply/print-head unit may be capable of producing only about 500 printed pages before exhausting its ink supply.

Alternately, the ink reservoir in an ink-jet printer may be separate from the print-head, coupled thereto via a system of electrical, hydraulic and/or pneumatic connections. In this way, the print-head mass is kept to an absolute minimum, allowing for the fastest possible print-head transport speeds. The path of ink flow from the supply to the delivery system must be broken at some point, however, if the reservoir is to be replaced; disconnecting the print-head from the reservoir can thus be a complex and messy task.

SUMMARY OF THE INVENTION

It is accordingly an object of the present invention to provide an ink-jet printer which overcomes the known deficiencies of the prior art. In particular, it is a primary object of the present invention to provide an ink-jet printing system which utilizes a self-contained print-head and ink supply cartridge which can be readily inserted or removed from the printer without requiring disconnection of or exposure to any part of the ink supply and delivery systems.

It is also an object of the present invention to provide an ink-jet printing system in which the ink supply is separate from the ink delivery system, connected thereto by flexible hoses which allow the print-head to be moved independently from the ink supply.

A further object of the present invention is to provide an ink-jet printer which has a large capacity ink reservoir allowing the printer to produce several thousand printed pages before the ink supply is exhausted.

The foregoing and other objects of the invention are accomplished in an ink-jet printer having a replaceable print-head/ink supply cartridge which includes a large capacity ink reservoir, the print-head ink-jets, the plumbing system for providing ink to the print-head, as well as the motion system for providing the back-and-forth movement of the print head. According to the present invention, the replaceable cartridge is totally sealed, preventing user-exposure to any part of the ink delivery system during replacement. Once the ink supply is exhausted, the sealed unit is replaced in a manner similar to that for replacing the imaging cartridge in conventional electrophotographic printers.

When the sealed cartridge in accordance with the present invention is installed in the main housing of an ink-jet printer, a modular electrical connection between electronic circuitry of the printer and the enclosed print-head is established. A drive gear of the enclosed print-head motion system is exposed such that it engages a motor permanently disposed within the printer housing. During operation, the print-head/ink-supply/-motion system enclosure remains stationary with respect to the printer housing, while the print-head moves within it. An elongated shutter mechanism in the enclosure opens during printing to expose the print-head to the printing surface. Since the ink-supply does not move with the print-head, the motion system is not subjected to the resistance of its mass, nor constrained by its size. This allows the motion system to be small and efficient, and further allows the ink-supply to be larger without degrading the performance of the printer.

Once the ink supply is exhausted, the enclosure is removed from the printer housing in a single motion, without exposing the user to any part of the ink delivery system or print-head motion system.

BRIEF DESCRIPTION OF THE DRAWINGS

The novel features believed characteristic of ink-jet printers in accordance with the present invention are set forth in the appended claims. The invention itself, however, as well as other features and advantages thereof, will be best understood by reference to a detailed description of a specific embodiment which follows, when read in conjunction with the accompanying drawings, wherein:

DETAILED DESCRIPTION OF A SPECIFIC EMBODIMENT

Figure 1:
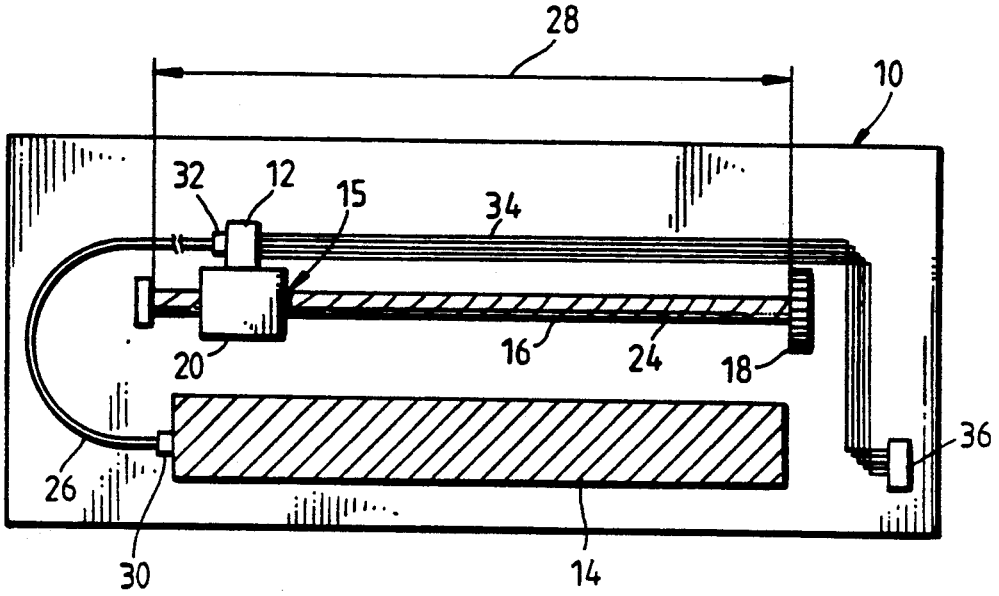
FIG. 1 is a simplified drawing of a printing system cartridge in accordance with one embodiment of the present invention.

Referring to FIG. 1, a printing system cartridge in accordance with one embodiment of the present invention shown. In keeping with a primary aspect of the invention, the cartridge of FIG. 1 is a substantially sealed unit, having an outer housing 10 which contains the ink-jet print-head 12, a large capacity ink-supply 14, as well as a motion system 15 for effecting the back-and-forth printing motion of print-head 12. Housing 10 may be constructed from molded plastic or the like, and may contain various internal features, such as struts, mounting pedestals, and compartments, for supporting the various internal components of the printing cartridge to be hereinafter described.

The motion system 15 in the cartridge of FIG. 1 mainly comprises a guide rod 16 axially coupled to a drive gear 18 disposed thereon. Print-head 12 is attached to a carriage 20 that slides back-and-forth along guide rod 16. Carriage 20 is propelled along guide rod 16 through the action of drive gear 18. In one embodiment of the invention, guide rod 16 is provided with a worm-gear style spiral groove 24 along its length which is engaged by carriage 20, such that rotational motion of guide rod 16 imparted through the turning of drive gear 18 draws carriage 20 along guide rod 16. This type of worm-gear print-head motion system is well-known in the printer art.

With continued reference to FIG. 1, a flexible hose 26 conducts liquid ink from ink-supply 14 to print-head 12. It is to be understood that hose 26 must be of sufficient length to afford print-head 12 and carriage 20 the fullest range of motion along guide rod 16. The extent of this motion is delineated generally by dashed line 28 in FIG. 1. Hose 26 is also preferably made of a lightweight material, so that it imposes no undue resistance upon the motion of carriage 20. Fittings 30 and 32 are employed in coupling hose 26 to ink-supply 14 and print-head 12, respectively. As cartridge 10 in accordance with a primary aspect of the present invention is a substantially sealed unit, however, a user is not required to manipulate fittings 30 and 32 at any time, and the path of ink in the entire ink-delivery system remains totally closed.

Print-head 12 also receives an electrical cable 34 for conducting print-head control signals from the printer electronics. In one embodiment of the invention, print-head 12 is of the aforementioned electrical-deflection type, and cable 34 provides to print-head 12 the control signals for charging the ink-droplets and the modulating signal for selectively deflecting the droplets during their flight from print-head 12 to the printing surface. In the alternative, print-head 12 could be of the thermal variety, with cable 34 providing the signals for controlling the resistive heating and vaporization of the ink-droplets. In any case, cable 34 is preferably light-weight and flexible, and, like hose 26, should be sufficiently long to allow the full range of motion of carriage 20 indicated by dashed line 28. For example, cable 34 could be a flat, laminated ribbon cable, such as is commonly used in applications that require electrical connections to moveable components. One end of cable 34 is coupled to print-head 12, while the other end is coupled to a modular electrical connector 36 disposed o a surface of housing 10. Cable 34 is attached to print-head 12 and connector 36 in a manner which allows the electrical connection between connector 36 and print-head 12 to withstand the stress of repeated back-and-forth motions without failure due to wire fatigue.

Figure 2:
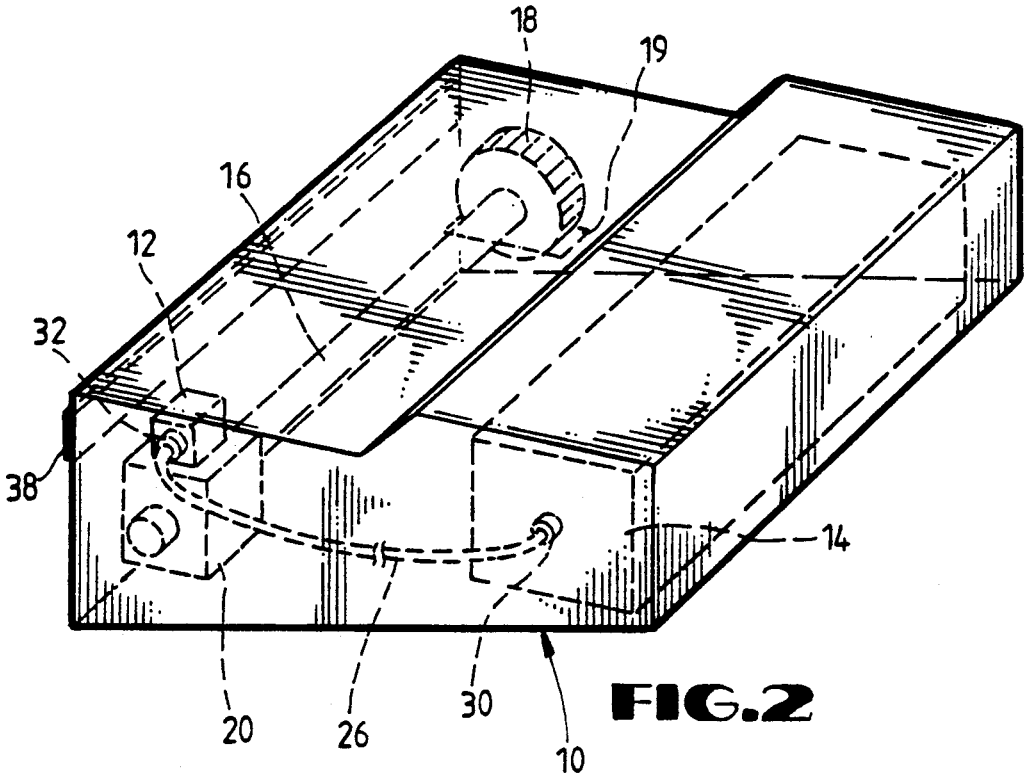
FIG. 2 is an oblique view of the printing system cartridge of FIG. 1.

Turning now to FIG. 2, an oblique view of the printing system cartridge of FIG. 1 is shown. Electrical connector 36 is shown protruding slightly from the underside of housing 10, such that it may come in contact with a mating connector when the cartridge is installed within a printer housing, as shall be hereinafter described. Similarly, drive gear 18 is partially or entire exposed in drive gear access hole 19, so that it may engage a compatible gear on a drive motor when the cartridge is installed in a printer housing.

Housing 10 is equipped with an elongated shutter 38 along its front, substantially planar face. Shutter 38 opens, such as by folding inward, when the printing cartridge is installed in a printer. This exposes an elongated slot in housing 10 corresponding to the path defined by the nozzles of print-head 12 as it travels along guide rod 16. When shutter 38 is open, ink-jet print-head 12 is exposed so that it may deposit ink-droplets onto a printing surface. In accordance with a primary aspect of the present invention, however, print-head 12 is uncovered by shutter 38 only when the cartridge is installed within a printer housing; before the cartridge is installed or after it is removed, shutter 38 prevents user-exposure to any part of the ink delivery system. Shutter 38 may be likened to the hinged protective flap on common VHS videotapes, which opens to expose the magnetic videotape surface to the record/playback heads only when the tape has been inserted into a videotape machine.

Figure 3:
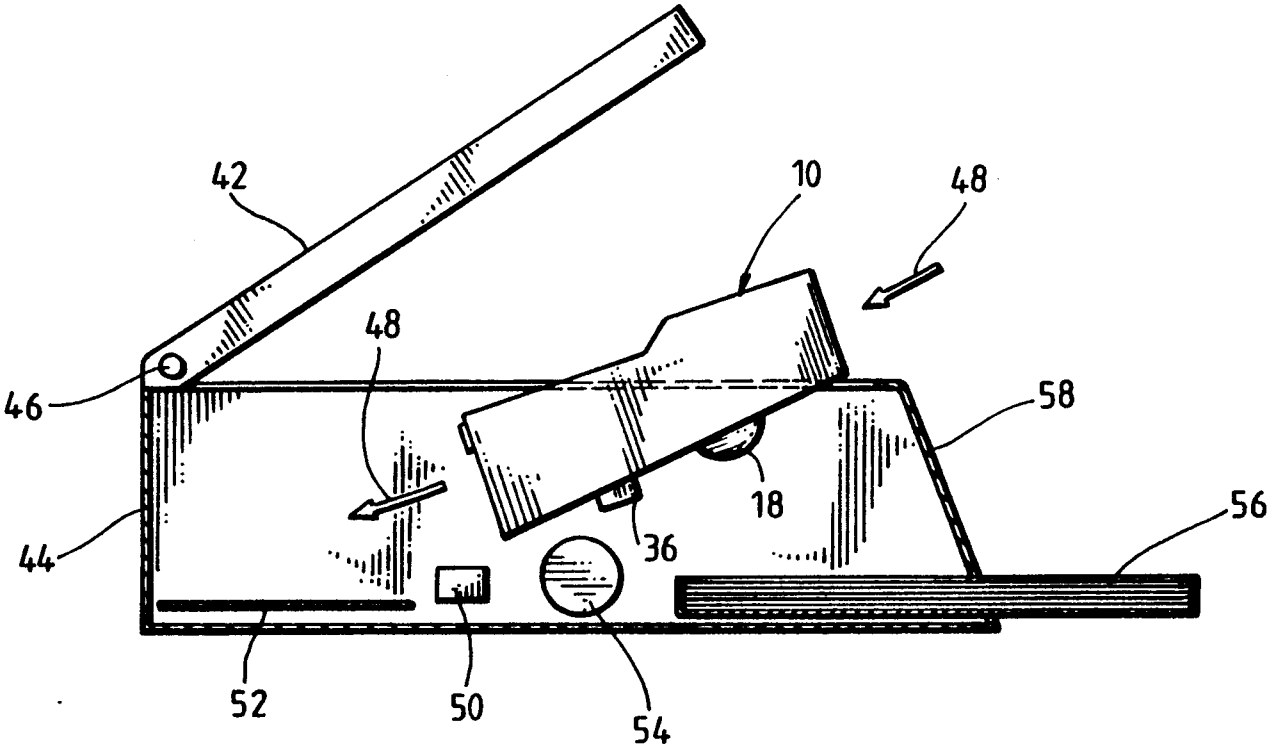
FIG. 3 is a diagram illustrating insertion of the cartridge of FIGS. 1 and 2 into an ink-jet printer utilizing the present invention.

Referring now to FIG. 3, a diagram showing insertion of a cartridge in accordance with one embodiment of the present invention into an ink-jet printer denoted generally as 40. In the printer of FIG. 3, a lid 42 is coupled to the base 44 of printer 40 by means of a hinge 46. With lid 42 open, a printer cartridge in accordance with the present invention is lowered into place in the base 44 of printer 40, as indicated by directional arrows 48. When the cartridge is in place, exposed electrical connector 36 is received in a mating connector 50 in printer 40, thus establishing a plurality of electrical connections between the electronic circuitry 52 of printer 40 and print-head 12.

With further reference to FIG. 3, drive gear 18 becomes coupled to motor 54 in printer 40, so that the turning of motor 54 causes the back-and-forth motion of carriage 20 and print-head 12 within housing 10. Housing 10 is stably supported within the base 44 of printer 40, such as by pins, clips, screws or other commonly practiced mounting techniques. Rigid support of housing 10 within base 44 is essential for consistent alignment of drive gear 18 with motor 54, of electrical connector 36 with connector 50, and of print-head 12 with printing surfaces. It is essential to note that insertion or removal of the printing cartridge from printer 40 does not involve the breaking of the ink-delivery system at any point. Additionally, while the ink system in entirely closed, the ink reservoir does not move along with the print-head during printing.

Paper on which images are printed by printer 40 is supplied from paper tray 56 in FIG. 3. For clarity, various mechanical components involved with the transportation of paper from tray 56, past the elongated print-head printing slot in housing 10, and out of the printer, are not shown in FIG. 3. User control of printer 40 is allowed via control switches and buttons, designated generally as 58 in FIG. 3, disposed on the front panel of printer 40.

From the above detailed description of a specific embodiment of the invention, it should be evident that a self-contained, user-replaceable printing system cartridge has been disclosed which is inserted and removed from an ink-jet printer without allowing user-exposure to liquid ink. The cartridge contains not only the print-head, ink-supply, and the plumbing system therebetween, but also the motion system for print-head. Although a specific embodiment has been disclosed in some detail, it is to be understood that various changes, alterations and substitutions can be made therein without departing from the spirit and scope of the present invention as defined in the appended claims.

For example, it should be evident that the printing system cartridge of the present invention is applicable, in concept, to any of the various types of ink-jet printers known in the printer art. Likewise, with respect to print-head motion system, it should be realized that the present invention is not limited in scope to a worm-gear implementation thereof, especially since the separation of the ink-supply from the print-head minimizes the mechanical burden on the print-head motion system. Finally, with regard to the depiction of the printer 40 of FIG. 3, it should be obvious that the details of placement of components therein are provided for illustrative purposes only; such details are not intended to constrain the scope of the invention to a particular arrangement of components (the motor, electronic circuitry, user control buttons, paper supply tray, etc...) in an ink-jet printer utilizing the printing system cartridge of the present invention.

What is claimed is:

1. A removable printing system cartridge for use in an ink-jet printer, comprising:

a housing having a front surface and a laterally extending elongated slot along said front surface, said housing further provided with a drive gear access opening and a modular electrical connector, said modular connector disposed on an outer surface of said housing;

a large-capacity ink reservoir disposed completely within said housing;

a guide rod having a longitudinal length and a drive gear mounted radially thereon, said guide rod mounted within said housing such that said drive gear is accessible from outside of said housing through said drive gear access opening;

a print-head carriage moveably coupled to said guide rod so that the print-head carriage can be drawn back and forth along the longitudinal length thereof under control of said drive gear;

an ink-jet print-head having ink-jet delivering nozzles, mounted on said carriage so that said nozzles are aligned with said elongated slot in the housing as said carriage moves back and forth along the guide rod, said print-head receiving a flexible ink-supply tube originating from said ink reservoir, said print-head electrically coupled to said modular electrical connector by a multiple-conductor cable; and a totally sealed ink delivery system comprising said print-head, flexible tube and ink reservoir;

wherein said elongated slot is covered by a retractable shutter when said printing system cartridge is not installed in said printer, said shutter being retracted when said cartridge is installed in said printer to allow said print-head to expel ink through said elongated slot onto a printing surface;

and wherein said exposed drive gear in mechanically coupled to a motor when said cartridge is installed in a printer, said motor being external to said cartridge housing;

and wherein said modular electrical connector engages a mating electrical connector in a printer when said cartridge is installed in said printer, allowing electrical signals to be conveyed to said print-head by said cable.

2. The removable printing system cartridge of claim 1 wherein said cartridge, including said housing, said modular electrical connector, said ink reservoir, said guide rod, said drive gear, said print-head carriage, said print-head and said flexible ink-supply tube, is a disposable unit.

3. An ink-jet printer for printing having a user-replaceable printing system cartridge, comprising:

a main chassis containing electronic circuitry for controlling printing, said electronic circuitry producing a plurality of electrical printing control signals which appear at a set of terminals of a first modular connector mounted within said main chassis;

a motor for moving an ink-jet print-head in a back-and-forth printing motion, said motor being mounted within said main chassis; and securing means for receiving and securing in place said user-replaceable printing system cartridge, said printing system cartridge comprising a housing having a laterally extending elongated slot therein and also having a drive gear access opening therein, and a second modular electrical connector mounted externally thereon, said cartridge housing completely encasing a laterally extending guide rod having a radially mounted drive gear thereon and having a longitudinal length, said guide rod mounted within said housing so that said guide rod extends substantially parallel with said elongated slot and so that said drive gear is accessible from outside said housing by said drive gear access opening, said cartridge further containing a carriage, moveably mounted on said guide rod so that the carriage can be drawn back and forth along the length thereof under control of said drive gear, said carriage having an ink-jet print-head mounted thereon such that said print-head is in alignment with said elongated slot as said carriage is drawn along said guide rod, said cartridge further containing an immovable, large-capacity liquid ink reservoir connected to said print-head by means of a flexible tube for providing ink-supply thereto;

and said cartridge further containing a totally sealed ink delivery system comprising said print-head, flexible tube and ink reservoir;

said print-head receiving an electrical cable originating at said second modular connector, said cable conducting electrical control signals to said print-head;

wherein said elongated slot is covered by a retractable shutter when said cartridge is removed from said printer chassis, said shutter being retracted when said cartridge is installed in said printer chassis to allow ink expelled from said print-head to exit said housing to be received on a printing surface, and wherein said first and second modular connectors are connected when said cartridge is installed in said chassis so that said electrical control signals are conducted between said electronic circuitry and said print-head, and wherein said cartridge can be removed from and installed in said chassis without breaching said sealed ink delivery system.

4. The ink-jet printer of claim 3 wherein the user-replaceable printing system cartridge, including said housing, said second modular electrical connector, said guide rod, said drive gear, said carriage, said print-head, said ink reservoir, said flexible tube, said electrical cable and said retractable shutter, is a disposable unit.

5. A method for replacing an ink supply in an ink-jet printer, comprising the steps of:

unsecuring and removing a substantially sealed printing system cartridge from a chassis of the ink-jet printer, and inserting in place and securing a replacement printing system cartridge in said chassis of the ink-jet printer, wherein said sealed printing system cartridge comprises an outer housing which contains:

a large capacity ink reservoir;

an ink-jet print-head, receiving ink supplied from said reservoir through a flexible tube, for applying ink to a printing surface;

a totally sealed ink delivery system comprising said print-head, flexible tube and reservoir;

a print-head motion system, for allowing back-and-forth printing movement of said print-head;

said housing being equipped with a motion system access hole, allowing a mechanical force generated externally to said housing to be applied to said motion system;

said housing also provided with an elongated, laterally extending slot for allowing ink expelled from said print-head to be received on said printing surface external to said housing, and further provided with an externally disposed modular electrical connector, for establishing electrical coupling with a mating connector disposed within said chassis of said printer;

said print-head motion system comprising a guide rod laterally extended and mounted within said housing, said guide rod mounted within said housing so that said guide rod extends substantially parallel with said elongated slot, said guide rod having a radially mounted drive gear thereon so that said drive gear is accessible from outside of said housing through said motion system access hole for receiving said externally generated mechanical force; and a carriage moveably mounted on said guide rod so that the carriage can be drawn back and forth along the length of said guide rod under control of said drive gear, and said carriage having said ink-jet print-head mounted thereon;

wherein the step of unsecuring and removing the sealed cartridge from said chassis of said printer includes the steps of:

decoupling said externally generated mechanical force from said motion system, and disconnecting the mating electrical connectors;

and wherein the step of inserting in place and securing the replacement cartridge in said chassis of said printer includes the steps of:

coupling said externally generated mechanical force to said motion system by way of said motion system access hole, and establishing electrical contact between said mating electrical connectors.

6. The method of claim 5 wherein said printing system cartridge, including said outer housing, said ink reservoir, said ink-jet print-head, said flexible tube, said modular electrical connector, said guide rod, said drive gear and said carriage, is a disposable unit.

7. An ink-jet printer, comprising:

a main chassis, including a mechanical system for exposing printing surfaces to an ink-jet print-head;

electronic circuitry for controlling printing;

a motor for providing a mechanical force required to move said ink-jet print-head in a back-and-forth printing motion;

a motion system, mechanically coupled to said motor, for allowing said back-and-forth printing motion of the ink-jet print-head; and a large capacity ink supply, for providing ink to said ink-jet print-head by way of a flexible connection therebetween;

a totally sealed ink delivery system comprising said ink-jet print-head, flexible connection and large capacity ink supply;

wherein said motion system, ink supply, and ink-jet print-head are enclosed within a housing of a removable cartridge, having a motion system access hole and a laterally elongated ink-jet access slot therein, and which is equipped with an electrical connector for providing electrical coupling of said print-head and said electronic circuitry;

said motion system comprising a guide rod having a longitudinal length laterally extended and mounted within said housing, said guide rod mounted within said housing such that said guide rod extends substantially parallel with said elongated slot, said guide rod having a radially mounted drive gear thereon such that said drive gear is accessible from outside of said housing through said motion system access hole for receiving said mechanical force; and a carriage moveably mounted on said guide rod, said carriage capable of being drawn back and forth along the length of said guide rod under control of said drive gear, and said carriage having said ink-jet print-head mounted thereon.

8. The ink-jet printer of claim 7 wherein said removable cartridge, including said ink-jet print-head, said ink supply, said flexible connection, said housing, said electrical connector, said guide rod, said drive gear and said carriage, is a disposable unit.

9. A removable printing system cartridge for use in an ink-jet printer, said cartridge having a substantially sealed outer housing which contains:

an ink-jet print-head;

a motion system for allowing back-and-forth motion of said print-head; and a large capacity ink supply, coupled to said ink-jet print-head by a flexible ink-supply hose;

a totally sealed ink delivery system comprising said ink-jet print-head, flexible ink-supply hose and large capacity ink supply;

wherein said motion system is mechanically connectable through a motion system access hole in said housing to a source of mechanical force external to said housing;

said motion system comprising a guide rod having a longitudinal length laterally extended and mounted within said housing, said guide rod mounted within said housing so that said guide rod extends substantially parallel with an elongated ink access slot for allowing ink expelled from said print-head to be received on a printing surface external to said housing, said guide rod having a radially mounted drive gear thereon such that said drive gear is accessible from outside of said housing through said motion system access hole for receiving said mechanical force; and a carriage moveably mounted on said guide rod, wherein said carriage can be drawn back and forth along the length of said guide rod under control of said drive gear, and said carriage having said ink-jet print-head mounted thereon.

10. The removable printing system cartridge of claim 9 wherein the cartridge, including said outer housing, said ink-jet print-head, said ink supply, said flexible ink-supply hose, said guide rod, said drive gear and said carriage, is a disposable unit.

11. An ink-jet printer having ink, an ink reservoir, and a movable print-head for expelling the ink onto a printing surface, the ink-jet printer further comprising:

(a) a totally sealed ink delivery system comprising the print-head, the ink reservoir and a means for connecting the print-head to the ink reservoir, whereby the ink is contained in the ink reservoir and delivered therefrom to the print-head by the connecting means;

(b) a disposable printing system cartridge comprising the totally sealed ink delivery system, a means for moving the print-head within the cartridge, and a means for controlling the expulsion of the ink by the print-head, the printing system cartridge being removable from the ink-jet printer;

whereby, after depletion of the ink from the ink reservoir by expulsion through the print-head onto the printing surface, the printing system cartridge is disposed of.

12. For use with an ink-jet printer, a disposable printing system cartridge having ink, an ink reservoir and a movable print-head for expelling the ink onto a printing surface comprising:

(a) a totally sealed ink delivery system comprising the print-head, the ink reservoir and a means for connecting the print-head to the ink reservoir, whereby the ink is contained in the ink reservoir and delivered therefrom to the print-head by the connecting means;

(b) a means for moving the print-head within the cartridge; and (c) a means for controlling the expulsion of the ink by the print-head.

* * * * *